US006116662A

United States Patent [19]

Johnson

[11] Patent Number: 6,116,662

[45] Date of Patent: Sep. 12, 2000

[54] FLUSH MOUNTED LATCH FOR A DOOR

[76] Inventor: Muriel Johnson, 1449 Grand Ave., Baldwin, N.Y. 11510-1903

[21] Appl. No.: 09/257,793

[22] Filed: Mar. 2, 1999

[51] Int. Cl.[7] ..... E05C 1/06

[52] U.S. Cl. ..... 292/142; 292/172; 292/DIG. 37

[58] Field of Search ..... 292/142, 172, 292/164, 336.3, 336.5, DIG. 37, 138, 39, 41; 74/110

[56] References Cited

U.S. PATENT DOCUMENTS

| | | | |
|---|---|---|---|
| 359,183 | 3/1887 | Sherwood | 292/172 |
| 788,515 | 5/1905 | Carlson | 292/DIG. 37 |
| 1,211,437 | 1/1917 | Gruber | 292/DIG. 37 |
| 3,561,805 | 2/1971 | Shaw | 292/172 |
| 3,991,520 | 11/1976 | Graham | 49/276 |
| 4,163,375 | 8/1979 | Fujitaki | 70/134 |
| 4,335,816 | 6/1982 | Rager | 206/444 |
| 4,461,501 | 7/1984 | Dumbser | 292/201 |
| 5,058,937 | 10/1991 | Miehe et al. | 292/34 |
| 5,346,266 | 9/1994 | Bisbing | 292/64 |
| 5,683,122 | 11/1997 | Lee | 292/39 |

*Primary Examiner*—B. Dayoan
*Assistant Examiner*—Clifford B Vaterlaus

[57] ABSTRACT

A flush mounted latch for a door that includes a housing, a bolt, first apparatus, and second apparatus. The first apparatus includes a pinion gear that is operatively connected to the bolt, a pivot arm that is pivotally mounted at one end to, but off center of, the pinion gear and pivotally mounted at another end to the bolt which allows the bolt to retract when the pinion gear is rotated, a first rack that is operatively connected to the second apparatus and gearingly engages an edge of the pinon gear, and when caused to move inwardly by the second apparatus, rotates the pinion gear and retracts the bolt, a second rack that is operatively connected to the second apparatus and gearingly engages an opposite edge of the pinon gear, and when caused to move inwardly by the second apparatus, rotates the pinion gear and retracts the bolt. The second apparatus includes a first plunger plate connected to the first rack for movement therewith, and when pushed, the first plunger plate causes the first rack to move inwardly and rotate the pinion gear and retract the bolt and a second plunger plate connected to the second rack for movement therewith, and when pushed, the second plunger plate causes the second rack to move inwardly and rotate the pinion gear and retract the bolt.

10 Claims, 2 Drawing Sheets

FLUSH MOUNTED LATCH FOR A DOOR

BACKGROUND OF THE INVENTION

1. Field of the Invention

The present invention relates to a latch for a door. More particularly, the present invention relates to a flush mounted latch for a door.

2. Description of the Prior Art

Numerous innovations for door latches have been provided in the prior art that will be described. Even though these innovations may be suitable for the specific individual purposes to which they address, however, they differ from the present invention.

FOR EXAMPLE, U.S. Pat. No. 3,991,520 to Graham teaches a push to open door opening assembly for appliance doors that includes a single molded opening piece positioned between front and back panels of a substantially hollow door with a push-button section projecting through the front panel and an actuator ram projecting through the back panel. A fulcrum point is provided on the molded piece and an integral spring maintains the fulcrum against the front panel and the push-button projecting through the front panel. Actuation of the push-button pivots the device around the fulcrum against the spring to force the actuator ram from the rear panel into contact with an appliance cabinet wall thereby biasing the door away from the cabinet wall and overcoming a releasable closure device which maintains the door in a closed position.

ANOTHER EXAMPLE, U.S. Pat. No. 4,895,403 to Osenkowski teaches a door handle in which the handle bar is first pushed inwardly about one pivot axis to permit the user to grip the handle, and then the handle bar is pulled outwardly about a second pivot axis in order to unlatch the door. Springs normally establish the handle bar at a normal position substantially filling the recess and are yieldable to permit the inward swinging movement of the handle about the first pivot axis and the pulling of the door handle outwardly about the second pivot axis.

FINALLY, STILL ANOTHER EXAMPLE, U.S. Pat. No. 5,058,937 to Miehe et al. teaches a flush door latch assembly that has a housing with a recess defined therein and a paddle within the recess. Pulling on the paddle causes a cam having a helical cam face to cooperate with a cam follower to cause rotation of a pivot plate that retracts the plunger bolt and permits a door, hatch or the like having the present door latch assembly to be opened. The plunger bolt travels towards the same side of the latch assembly that the paddle travels towards when the plunger bolt is being retracted.

It is apparent that numerous innovations for door latches have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a flush mounted latch for a door that avoids the disadvantages of the prior art.

ANOTHER OBJECT of the present invention is to provide a flush mounted latch for a door that is simple and inexpensive to manufacture.

STILL ANOTHER OBJECT of the present invention is to provide a flush mounted latch for a door that is simple to use.

BRIEFLY STATED, YET ANOTHER OBJECT of the present invention is to provide a flush mounted latch for a door that includes a housing, a bolt, first apparatus, and second apparatus. The first apparatus includes a pinion gear that is operatively connected to the bolt, a pivot arm that is pivotally mounted at one end to, but off center of, the pinion gear and pivotally mounted at another end to the bolt which allows the bolt to retract when the pinion gear is rotated, a first rack that is operatively connected to the second apparatus and gearingly engages an edge of the pinon gear, and when caused to move inwardly by the second apparatus, rotates the pinion gear and retracts the bolt, a second rack that is operatively connected to the second apparatus and gearingly engages an opposite edge of the pinon gear, and when caused to move inwardly by the second apparatus, rotates the pinion gear and retracts the bolt. The second apparatus includes a first plunger plate connected to the first rack for movement therewith, and when pushed, the first plunger plate causes the first rack to move inwardly and rotate the pinion gear and retract the bolt and a second plunger plate connected to the second rack for movement therewith, and when pushed, the second plunger plate causes the second rack to move inwardly and rotate the pinion gear and retract the bolt.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawing are briefly described as follows.

LIST OF REFERENCE NUMERALS UTILIZED IN THE DRAWING

Figure 1:
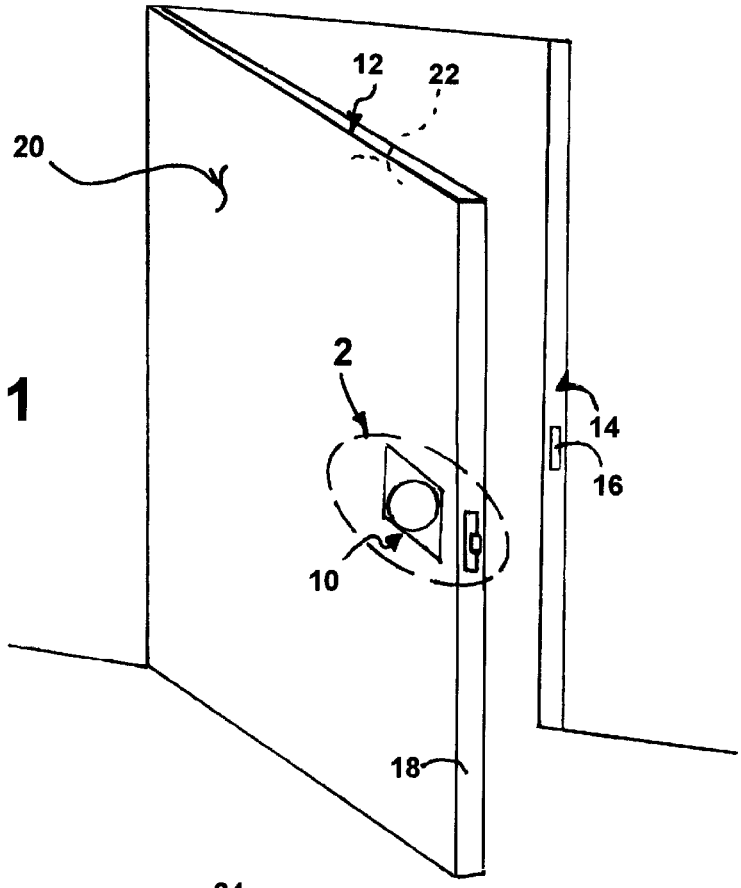
FIG. 1 is a diagrammatic perspective view of the preset invention installed in a door.

10 flush mounted latch for a door of the present invention
12 door
14 jamb of door 12
16 striker plate of jamb 14 of door 12
18 edge of door 12
20 front surface of door 12
22 back surface of door 12
24 housing for mounting in the door and communicating with edge 18 of door 12, front surface 20 of door 12, and back surface 22 of door 12
26 bolt
28 first apparatus
30 second apparatus for being normally flush with front surface 20 of door 12 and back surface 22 of door 12
32 end wall of housing 24 for being flush with edge 18 of door 12
34 first wall of housing 24 for being flush with front surface 20 of door 12
36 second wall of housing 24 for being flush with back surface 22 of door 12
38 sleeve of housing 24
40 pinion gear of first apparatus 28
42 center of pinion gear 40 of first apparatus 28

43 pivot arm of first apparatus 28
44 one end of pivot arm 43 of first apparatus 28
46 another end of pivot arm 43 of first apparatus 28
48 first rack of first apparatus 28
50 edge of pinon gear 40 of first apparatus 28
52 second rack of first apparatus 28
54 opposite edge of pinon gear 40 of first apparatus 28
56 first plunger plate of second apparatus 30 for normally mounting flush with front side 20 of door 12
58 second plunger plate of second apparatus 30 for normally mounting flush with back side of door 12
60 first coil spring of second apparatus 30
62 second coil spring of second apparatus 30
64 third coil spring of second apparatus 30
66 first stop of second apparatus 30
68 second stop of second apparatus 30

DESCRIPTION OF THE PREFERRED EMBODIMENT

Referring now to the figures, in which like numerals indicate like parts, and particularly to FIG. 1, which is a diagrammatic perspective view of the present invention installed in a door, the flush mounted latch for a door of the present invention is shown generally at 10 for a door 12, wherein the door 12 has a jamb 14 with a striker plate 16, an edge 18 facing the striker plate 16, a front surface 20, and a back surface 22 that is disposed opposite to the front surface 20.

Figure 2:
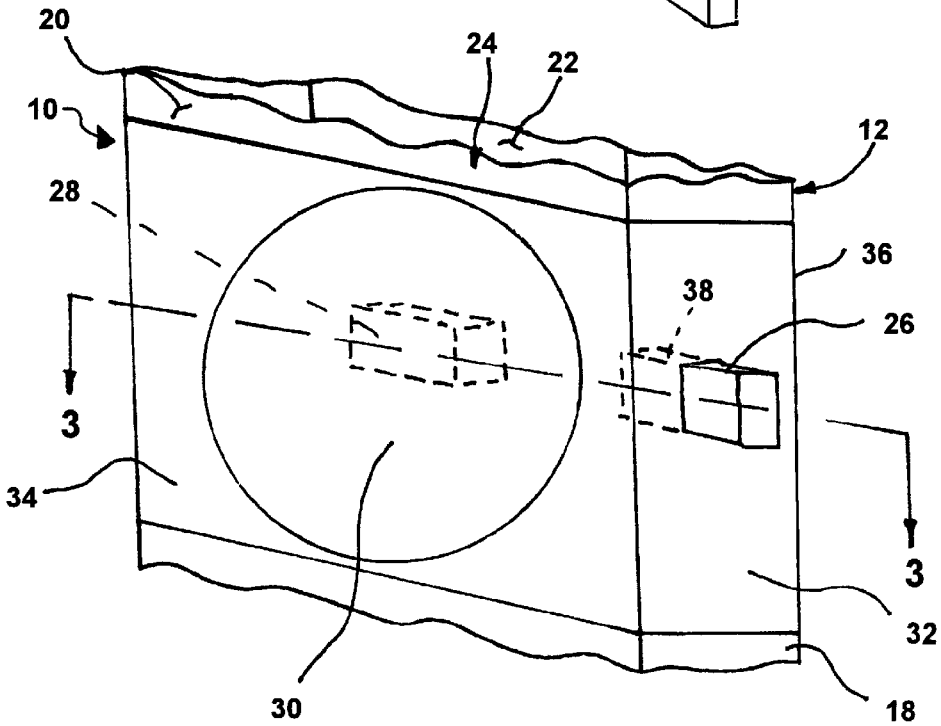
FIG. 2 is an enlarged diagrammatic perspective view of the area generally enclosed by the dotted curve identified by ARROW 2 in FIG. 1 of the present invention.

The overall configuration of the flush mounted latch for a door 10 can best be seen in FIG. 2, which is an enlarged diagrammatic perspective view of the area generally enclosed by the dotted curve identified by ARROW 2 in FIG. 1 of the present invention, and as such, will be discussed with reference thereto.

The flush mounted latch for a door 10 comprises a housing 24 for mounting in the door 12 and communicating with the edge 18 of the door 12, the front surface 20 of the door 12, and the back surface 22 of the door 12.

The flush mounted latch for a door 10 further comprises a bolt 26 selectively retractable into the housing 24, and when extended, engaging in the striker plate 16 of the door 12 preventing the door 12 from being opened, and when retracted, clearing the striker plate 16 of the door allowing the door 12 to be opened.

The flush mounted latch for a door 10 further comprises first apparatus 28 disposed in the housing 24 and operatively connected to, and moving, the bolt 26 from an extended position to a retracted position and vise versa.

The flush mounted latch for a door 10 further comprises second apparatus 30 for being normally flush with the front surface 20 of the door 12 and the back surface 22 of the door 12, and operatively connected to the bolt 26 and the first apparatus 28, and when pushed, activating the first apparatus 28 and opening the door 12.

The housing 24 is hollow and generally rectangular-parallelepiped-shaped, and has an end wall 32 for being flush with the edge 18 of the door 12, a first wall 34 for being flush with the front surface 20 of the door 12, and a second wall 36 for being flush with the back surface 22 of the door 12.

The bolt 26 is slidably movable through the end wall 32 of the housing 24.

The housing 24 further has a sleeve 38 that extends inwardly from the end wall 32 of the housing 24 and guides the bolt 26 slidably through the end wall 32 of the housing 24.

Figure 3:
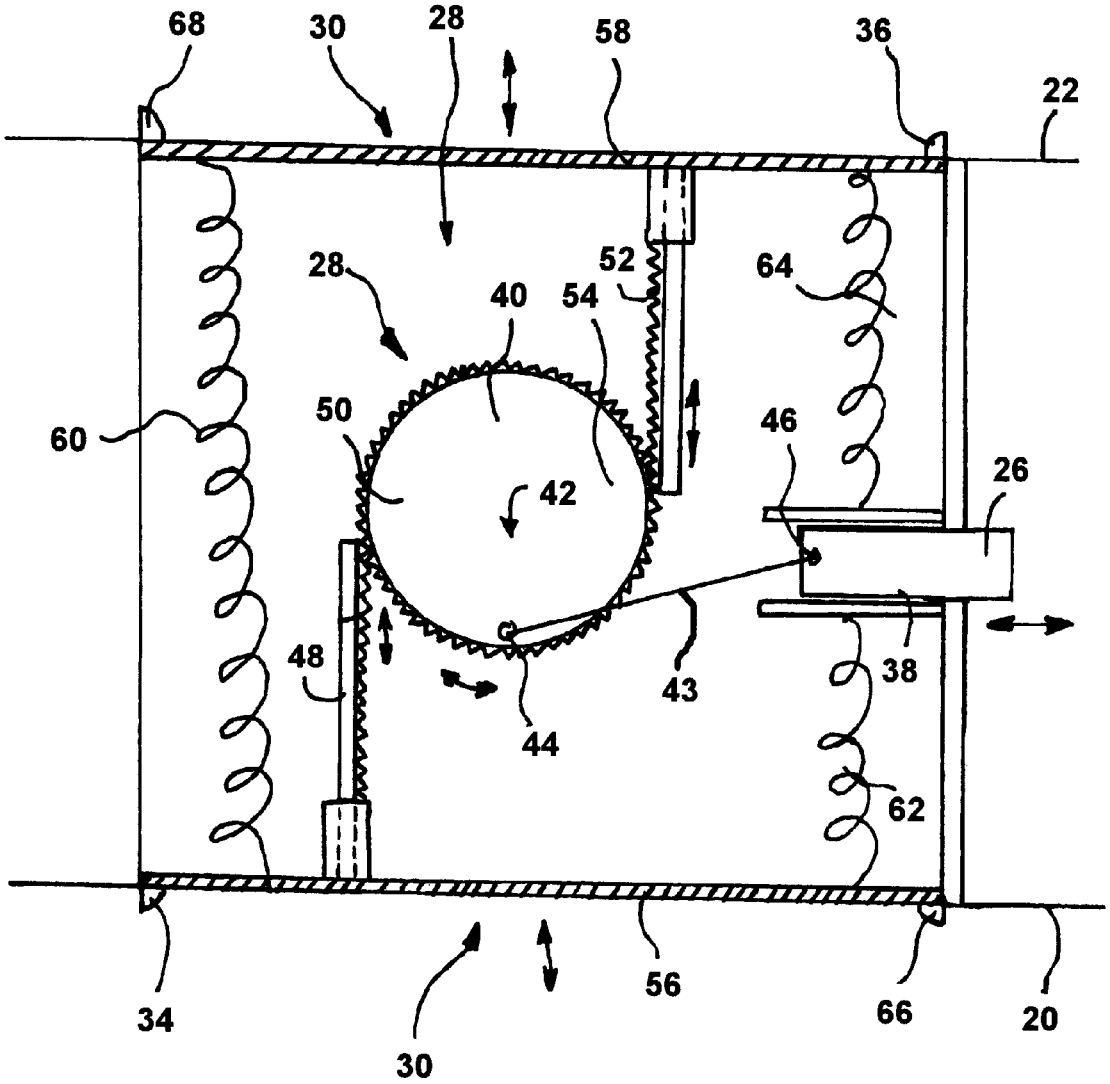
FIG. 3 is a diagrammatic cross sectional view taken on LINE 3—3 in FIG. 2 of the first and second apparatus of the present invention.

The specific configuration of the first apparatus 28 and the second apparatus 30 can best be seen in FIG. 3, which is a diagrammatic cross sectional view taken on LINE 3—3 in FIG. 2 of the first and second apparatus of the present invention, and as such, will be discussed with reference thereto.

The first apparatus 28 comprises a pinion gear 40 that has a center 42 and is rotatable mounted in the housing 24, and is disposed normal to, and between, the first wall 34 of the housing 24 and the second wall 36 of the housing 24 for rotation relative thereto, and is operatively connected to the bolt 26.

The first apparatus 28 further comprises a pivot arm 43 that is pivotally mounted at one end 44 to, but off the center of, the pinion gear 40, and is pivotally mounted at another end 46 to the bolt 26, which allows the bolt 26 to retract when the pinion gear 40 is rotated in one direction.

The first apparatus 28 further comprises a first rack 48 that is operatively connected to the second apparatus 30 and gearingly engages an edge 50 of the pinon gear 40, and when caused to move inwardly by the second apparatus 30, rotates the pinion gear 40 in the one direction and retracts the bolt 26.

The first apparatus 28 further comprises a second rack 52 that is operatively connected to the second apparatus 30 and gearingly engages an opposite edge 54 of the pinon gear 40, and when caused to move inwardly by the second apparatus 30, rotates the pinion gear 40 in the one direction and retracts the bolt 40. The second rack 52 moves opposite to the first rack 48.

The second apparatus 30 comprises a first plunger plate 56 for normally mounting flush with the front side 20 of the door 12, and being connected to the first rack 48 for movement therewith, and when pushed, the first plunger plate 56 causes the first rack 48 to move inwardly and rotate the pinion gear 40 in the one direction and retract the bolt 26.

The second apparatus 30 further comprises a second plunger plate 58 for normally mounting flush with the back side 22 of the door 12, and being connected to the second rack 52 for movement therewith, and when pushed, the second plunger plate 58 causes the second rack 52 to move inwardly and rotate the pinion gear 40 in the one direction and retract the bolt 26.

The second apparatus 30 further comprises a first coil spring 60 that extends from the first plunger plate 56 to the second plunger plate 58.

The second apparatus 30 further comprises a second coil spring 62 that extends from the first plunger plate 56 to the sleeve 38 of the housing 24.

The second apparatus 30 further comprises a third coil spring 64 that extends from the second plunger plate 58 to the sleeve 38 of the housing 24.

The first coil spring 60 and the second coil spring 62 bias the first plunger plate 56 flush with the front surface 20 of the door 12 so as to allow the first plunger plate 56 to return to its normal flush position when it is no longer pushed, with a first stop 66 for preventing the first plunger plate 56 from extending past the front surface 20 of the door 12, and during achieving its normal flush position, the first plunger plate 56 causes the first rack 48 to move outwardly which causes the pinion gear 40 to rotate in an opposite direction and extend the bolt 26.

The first coil spring 60 and the third coil spring 64 bias the second plunger plate 58 flush with the back surface 22 of the door 12 so as to allow the second plunger plate 58 to return to its normal flush position when it is no longer pushed, with a second stop 68 for preventing the second plunger plate 58 from extending past the back surface 22 of the door 12, and during achieving its normal flush position, the second plunger plate 58 causes the second rack 52 to move outwardly which causes the pinion gear 40 to rotate in the opposite direction and extend the bolt 26.

The first rack 48 is telescopic and normally bottomed out so as to prevent the first plunger plate 56 from moving inwardly when the second plunger plate 58 is pushed.

The second rack 52 is telescopic and normally bottomed out so as to prevent the second plunger plate 58 from moving inwardly when the first plunger plate 56 is pushed.

It will be understood that each of the elements described above, or two or more together, may also find a useful application in other types of constructions differing from the types described above.

While the invention has been illustrated and described as embodied in a flush mounted latch for a door, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A flush mounted latch for a door, wherein the door has a jamb with a striker plate, an edge facing the striker plate, a front surface, and a back surface that is disposed opposite to the front surface, said latch comprising:

a) a housing for mounting in the door and communicating with the edge of the door, the front surface of the door, and the back surface of the door; said housing being hollow and generally rectangular-parallelepiped-shaped, and having:

i) an end wall for being flush with the edge of the door;

ii) a first wall for being flush with the front surface of the door;

iii) a second wall for being flush with the back surface of the door; and iv) a sleeve extending inwardly from said end wall of said housing and guiding a bolt slidably through said end wall of said housing;

b) said bolt selectively retractable into said housing, and when extended, engaging in the striker plate of the door preventing the door from being opened, and when retracted, clearing the striker plate of the door allowing the door to be opened;

c) first apparatus disposed in said housing and operatively connected to, and moving, said bolt from an extended position to a retracted position and vise versa; said first apparatus comprising:

i) a pinion gear having a center and being rotatable mounted in said housing, and being disposed normal to, and between, said first wall of said housing and said second wall of said housing for rotation relative thereto, and being operatively connected to said bolt;

ii) a pivot arm being pivotally mounted at one end to, but off said center of, said pinion gear, and being pivotally mounted at another end to said bolt, allowing said bolt to retract when said pinion gear is rotated in one direction;

iii) a first rack being operatively connected to a second apparatus and gearingly engaging an edge of said pinion gear, and when caused to move inwardly by said second apparatus, rotating said pinion gear in said one direction and retracting said bolt; and iv) a second rack being operatively connected to said second apparatus and gearingly engaging an opposite edge of said pinion gear, and when caused to move inwardly by said second apparatus, rotating said pinion gear in said one direction and retracting said bolt; said second rack moving opposite to said first rack; and d) said second apparatus for being normally flush with said front surface of said door and said back surface of said door, and operatively connected to said bolt and said first apparatus, and when pushed, activating said first apparatus and opening the door; said second apparatus comprising a first plunger plate for normally mounting flush with the front side of the door, and being connected to said first rack for movement therewith, and when pushed, said first plunger plate causing said first rack to move inwardly and rotating said pinion gear in said one direction and retracting said bolt.

2. The latch as defined in claim 1, wherein said bolt is slidably movable through said end wall of said housing.

3. The latch as defined in claim 1, wherein said second apparatus further comprises a second plunger plate for normally mounting flush with the back side of the door, and being connected to said second rack for movement therewith, and when pushed, said second plunger plate causes said second rack to move inwardly and rotate said pinion gear in said one direction and retract said bolt.

4. The latch as defined in claim 3, wherein said second apparatus further comprises a first coil spring that extends from said first plunger plate to said second plunger plate.

5. The latch as defined in claim 4, wherein said second apparatus further comprises a second coil spring that extends from said first plunger plate to said sleeve of said housing.

6. The latch as defined in claim 4, wherein said second apparatus further comprises a third coil spring that extends from said second plunger plate to said sleeve of said housing.

7. The latch as defined in claim 6, wherein said first coil spring and said second coil spring bias said first plunger plate flush with the front surface of the door so as to allow said first plunger plate to return to its normal flush position when it is no longer pushed, with a first stop for preventing said first plunger plate from extending past the front surface of the door, and during achieving its normal flush position, said first plunger plate causes said first rack to move outwardly which causes said pinion gear to rotate in an opposite direction and extend said bolt.

8. The latch as defined in claim 7, wherein said first coil spring and said third coil spring bias said second plunger plate flush with the back surface of the door so as to allow said second plunger plate to return to its normal flush position when it is no longer pushed, with a second stop for preventing said second plunger plate from extending past the back surface of the door, and during achieving its normal flush position, said second plunger plate causes said second rack to move outwardly which causes said pinion gear to rotate in said opposite direction and extend said bolt.

9. The latch as defined in claim 3, wherein said first rack is telescopic and normally bottomed out so as to prevent said first plunger plate from moving inwardly when said second plunger plate is pushed.

10. The latch as defined in claim 3, wherein said second rack is telescopic and normally bottomed out so as to prevent said second plunger plate from moving inwardly when said first plunger plate is pushed.

* * * * *